US010547134B1

(12) United States Patent
Lee et al.

(10) Patent No.: US 10,547,134 B1
(45) Date of Patent: Jan. 28, 2020

(54) DETACHABLE CONNECTION PORT AND ELECTRONIC DEVICE HAVING THE SAME

(71) Applicant: Getac Technology Corporation, Hsinchu County (TW)

(72) Inventors: Kun-Cheng Lee, Taipei (TW); Juei-Chi Chang, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 4 days.

(21) Appl. No.: 16/038,615

(22) Filed: Jul. 18, 2018

(51) Int. Cl.

| | |
|---|---|
| ***H01R 12/73*** | (2011.01) |
| ***H01R 12/70*** | (2011.01) |
| ***H01R 12/52*** | (2011.01) |
| ***H01R 13/207*** | (2006.01) |

(52) U.S. Cl.
CPC ..... *H01R 12/732* (2013.01); *H01R 12/523* (2013.01); *H01R 12/7082* (2013.01); *H01R 12/7088* (2013.01); *H01R 13/207* (2013.01); *H01R 2201/06* (2013.01)

(58) Field of Classification Search
CPC ..... H01R 12/523; H01R 12/732; H01R 12/7082; H01R 12/7088; H01R 13/207; H01R 2201/06; H05K 1/141
See application file for complete search history.

(56) References Cited

U.S. PATENT DOCUMENTS

| | | | | | |
|---|---|---|---|---|---|
| 4,878,848 | A * | 11/1989 | Ingalsbe | H01R 31/06 | 439/76.1 |
| 5,501,608 | A * | 3/1996 | Scheer | H01R 31/06 | 439/218 |
| 6,217,228 | B1 * | 4/2001 | Samela | H01R 31/005 | 174/359 |
| 7,074,061 | B1 * | 7/2006 | Roth | G06K 19/07743 | 439/131 |
| 8,162,691 | B2 * | 4/2012 | Chang | H01R 13/514 | 439/541.5 |
| 9,997,851 | B1 * | 6/2018 | Ekrot | H01R 12/716 | |
| 10,135,164 | B1 * | 11/2018 | Shih | H01R 12/716 | |
| 2003/0008552 | A1 * | 1/2003 | Lin | H01R 13/6215 | 439/541.5 |
| 2011/0043979 | A1 * | 2/2011 | Saito | G06F 1/1616 | 361/679.01 |
| 2011/0249419 | A1 * | 10/2011 | Sun | H01R 12/7011 | 361/803 |

(Continued)

*Primary Examiner* — Oscar C Jimenez
(74) *Attorney, Agent, or Firm* — Locke Lord LLP; Tim Tingkang Xia, Esq.

(57) ABSTRACT

The present invention relates to a detachable connection port and an electronic device having the same. The detachable connection port is detachably assembled at an electronic device, which includes a board-to-board connector. The detachable connector includes a sub circuit board and a socket connector. The sub circuit board includes a golden finger. The socket connector is fixed at and electrically connected to the sub circuit board, and includes an installation portion. The socket connector is installed at the electronic device through the installation portion, and is electrically connected to the board-to-board connector through the golden finger. Thus, the detachable connection port achieves an advantage of easy replacement, further reducing repair costs and standby time for a user.

9 Claims, 7 Drawing Sheets

(56) References Cited

U.S. PATENT DOCUMENTS

| | | | | |
|---|---|---|---|---|
| 2011/0281444 | A1* | 11/2011 | Yasuoka | H01R 13/447<br>439/39 |
| 2013/0229130 | A1* | 9/2013 | Takamatsu | H02M 7/44<br>315/291 |
| 2013/0280940 | A1* | 10/2013 | Pai | H01R 13/62<br>439/345 |
| 2013/0301226 | A1* | 11/2013 | Chen | H05K 1/141<br>361/737 |
| 2017/0040744 | A1* | 2/2017 | Joo | H01R 13/648 |
| 2017/0085042 | A1* | 3/2017 | Qiao | H01R 12/57 |
| 2018/0138646 | A1* | 5/2018 | Chuang | H05K 1/117 |

* cited by examiner

DETACHABLE CONNECTION PORT AND ELECTRONIC DEVICE HAVING THE SAME

BACKGROUND OF THE INVENTION

Field of the Invention

The invention relates to a connector structure installed at an electronic device, and more particularly to a detachable connection port and an electronic device having the same.

Description of the Prior Art

Various electronic devices are installed with connectors to provide a power charging or data transmission function thereto. However, because the connection is needed only when power charging or data transmission needs to be performed, a connector often undergoes multiple times of plugging and unplugging. Further, due to differences in user habits, a connector is susceptible to receiving abnormal external forces or unaligned plugging and unplugging, eventually leading to malfunctioning problems like breakage or poor contact.

Current connectors are disposed on electronic devices by means of surface mount technology (SMT), or are mounted in housings by other strip-type forms. When a connector is damaged, an entire device needs to be sent to a repair station for repairs, which at the same time results in substantial repair costs and time costs and hence user inconveniences.

In view of the above, the Applicant is dedicated to related researches by incorporating the use of science in regard to the above prior art, and aims at an object of developing a solution for resolving the above issues.

SUMMARY OF THE INVENTION

The present invention provides a detachable connection port and an electronic device having the detachable connection port. The detachable connection port can be loosened or fastened through a fastening element, so as to achieve an advantage of conveniently replacing the detachable connection port and further reducing repair costs and standby time for a user.

In one embodiment of the present invention, the present invention provides a detachable connection port detachably installed at an electronic device, which includes a board-to-board connector. The detachable connection port includes: a sub circuit board, including a golden finger; and a socket connector, fixed at and electrically connector to the sub circuit board, the socket connector including an installation portion, being installed at the electronic device through the installation portion, and electrically connected to the board-to-board connector through the golden finger.

In one embodiment of the present invention, the present invention provides an electronic device having a detachable connection port. The electronic device includes: a main housing, having an opening; a main circuit board, provided in the main housing; a board-to-board connector, fixed at and electrically connected to the main circuit board, the board-to-board connector including a first connector head configured correspondingly to the opening; a detachable connection port, detachably insertingly connected at the opening, the detachable connection port comprising: a sub circuit board, comprising a golden finger, the golden finger electrically inserting connected at the first connector head; and at least one socket connector, fixed at and electrically connected to the sub circuit board, the socket connector including a second connector head exposed at the opening and an installation portion provided on one side of the second connector; and a fastening element, fixedly connected at the installation portion and the main housing.

On the basis of the above disclosure, when the detachable connection port is damaged, a user is only required to purchase a new detachable connector and the user can then replace the detachable connection port by loosening and fastening the fastening element without having to send the electronic device to an original manufacturer for repairs, achieving advantages of easy replacement of the electronic device and the detachable connection port and hence reducing repair costs and standby time for the user.

On the basis of the above disclosure, the board-to-board connector is a Peripheral Component Interconnect Express (PCIE) connector, a GEN3 connector or an M.2 connector. Thus, a user may also replace the detachable connection port by a connector having difference standards, such as a Universal Serial Bus (USB) Type-A connector, a High-Definition Multimedia Interface (HDMI) connector or a USB Type-C connector, further enhancing the utilization convenience of the electronic device and the detachable connection port.

DETAILED DESCRIPTION OF THE EMBODIMENTS

Details and technical contents of the present invention are given with the accompanying drawings below. It should be noted that the accompanying drawings are for illustration purposes and are not to be construed as limitations to the present invention.

Figure 1:
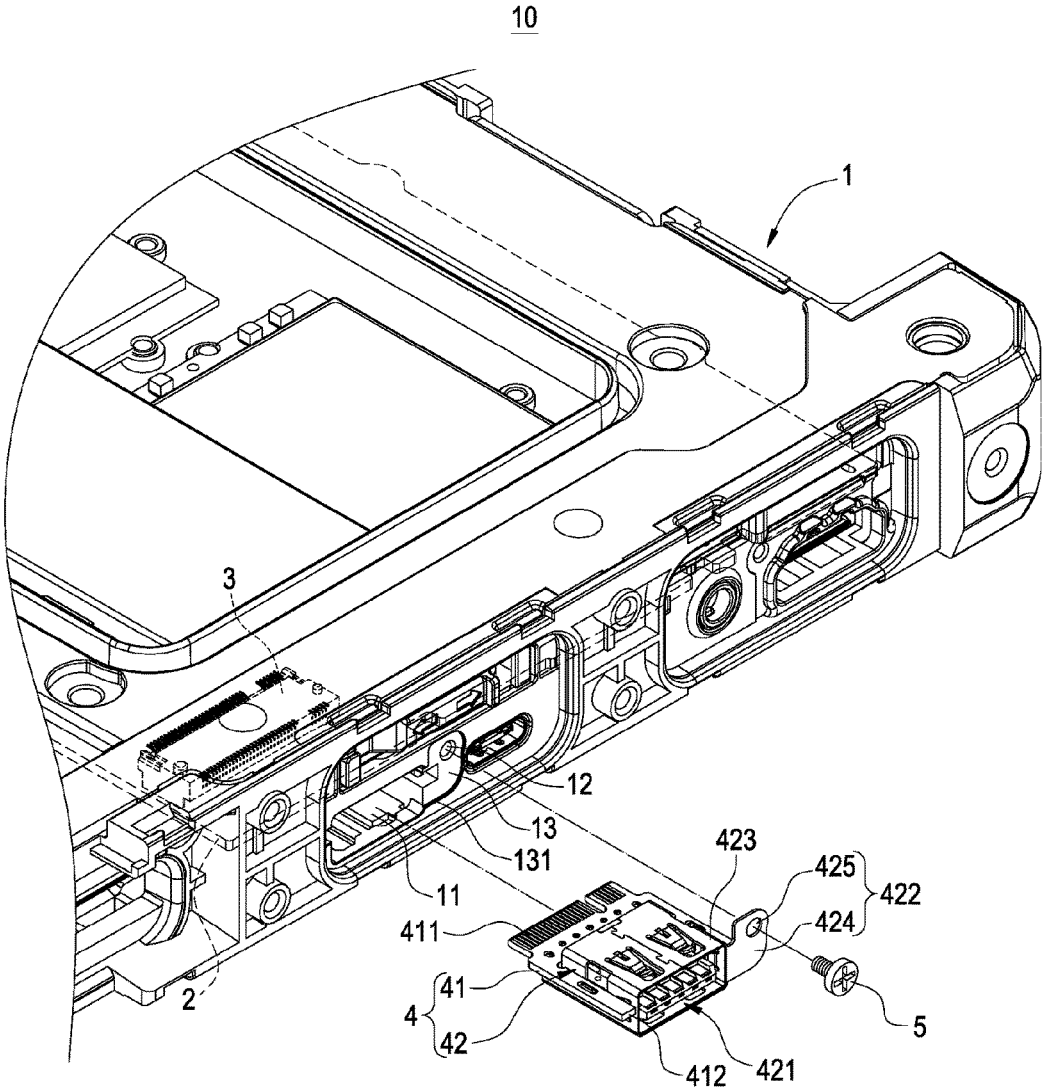
FIG. 1 is an exploded elevational view of an electronic device of the present invention.
Figure 2:
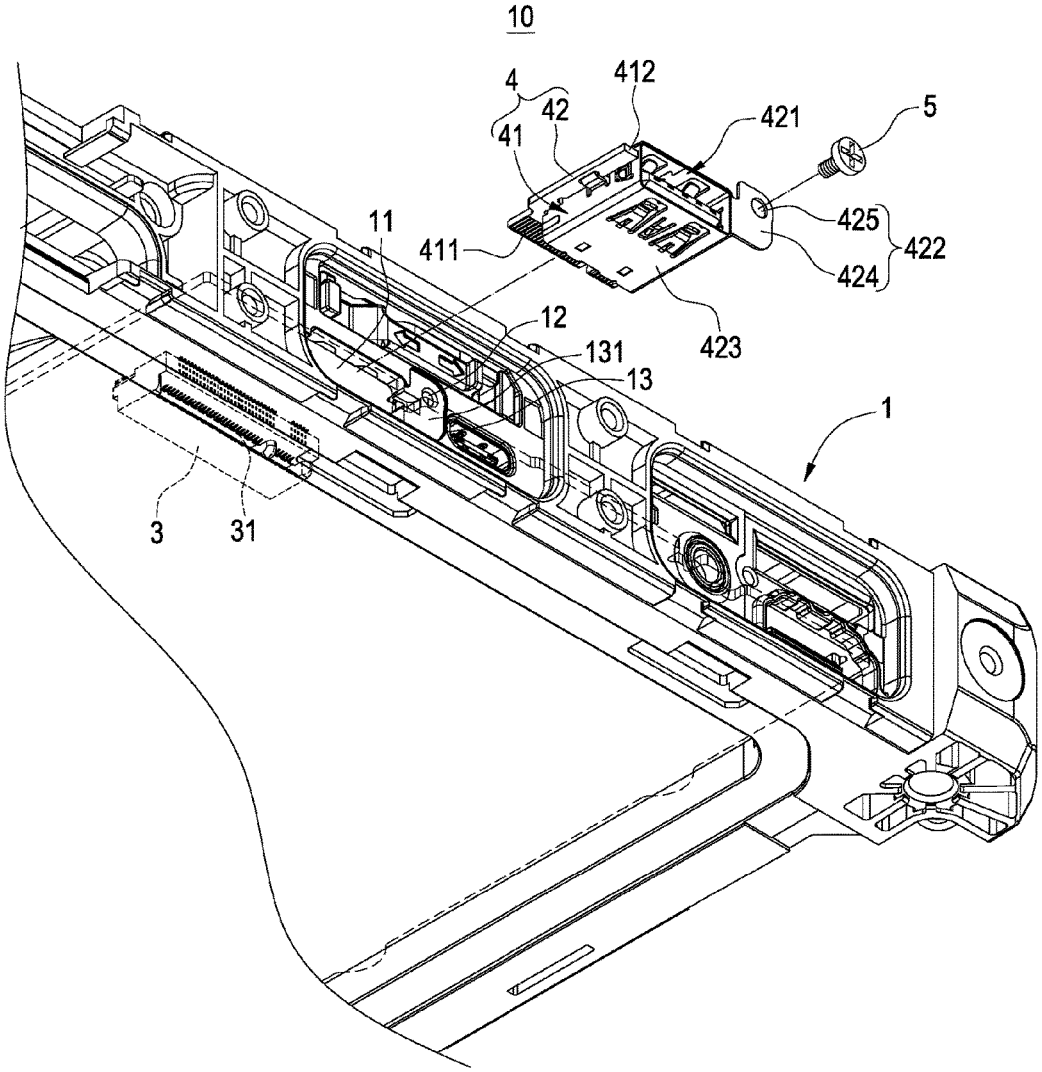
FIG. 2 is another exploded elevational view of an electronic device of the present invention.
Figure 3:
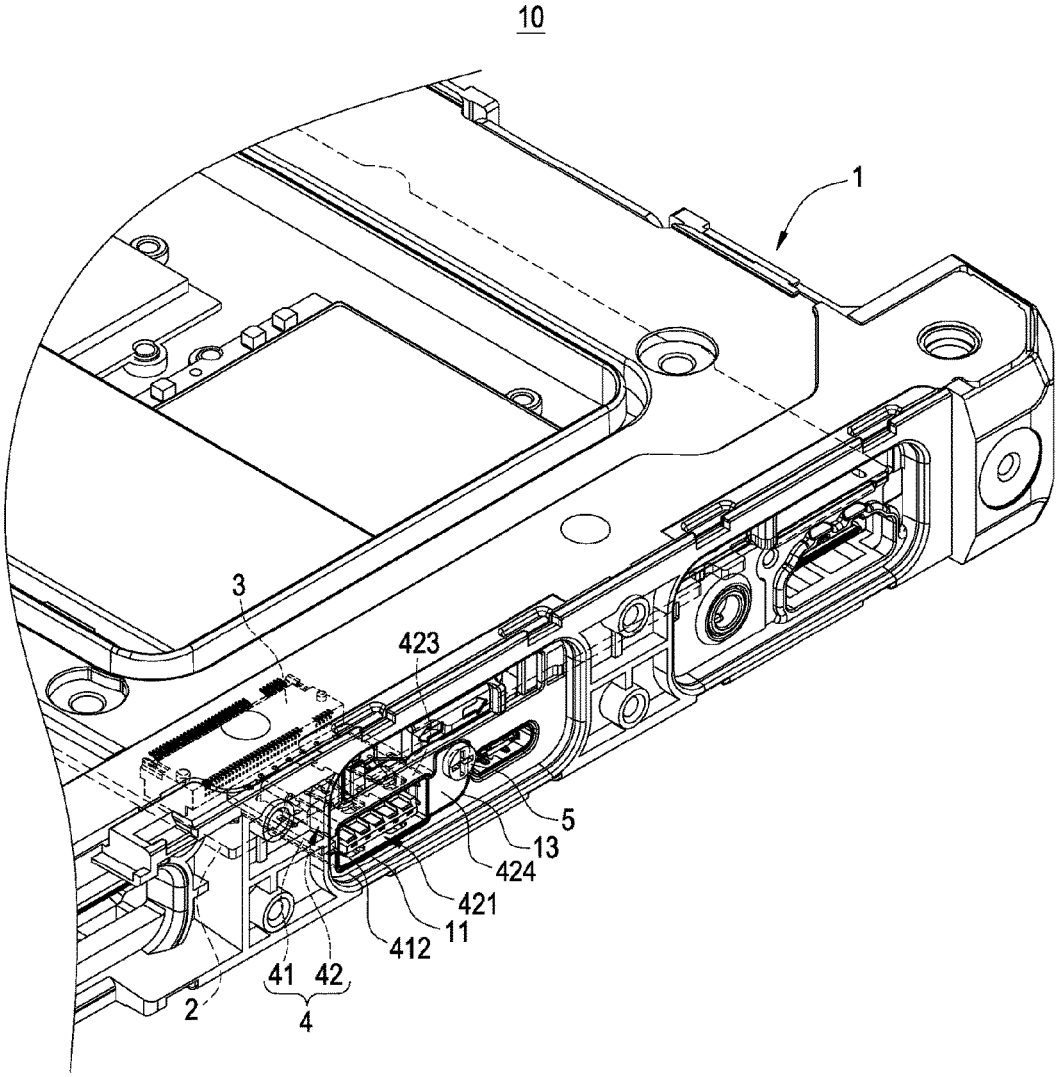
FIG. 3 is an elevational assembly diagram of an electronic device of the present invention.
Figure 4:
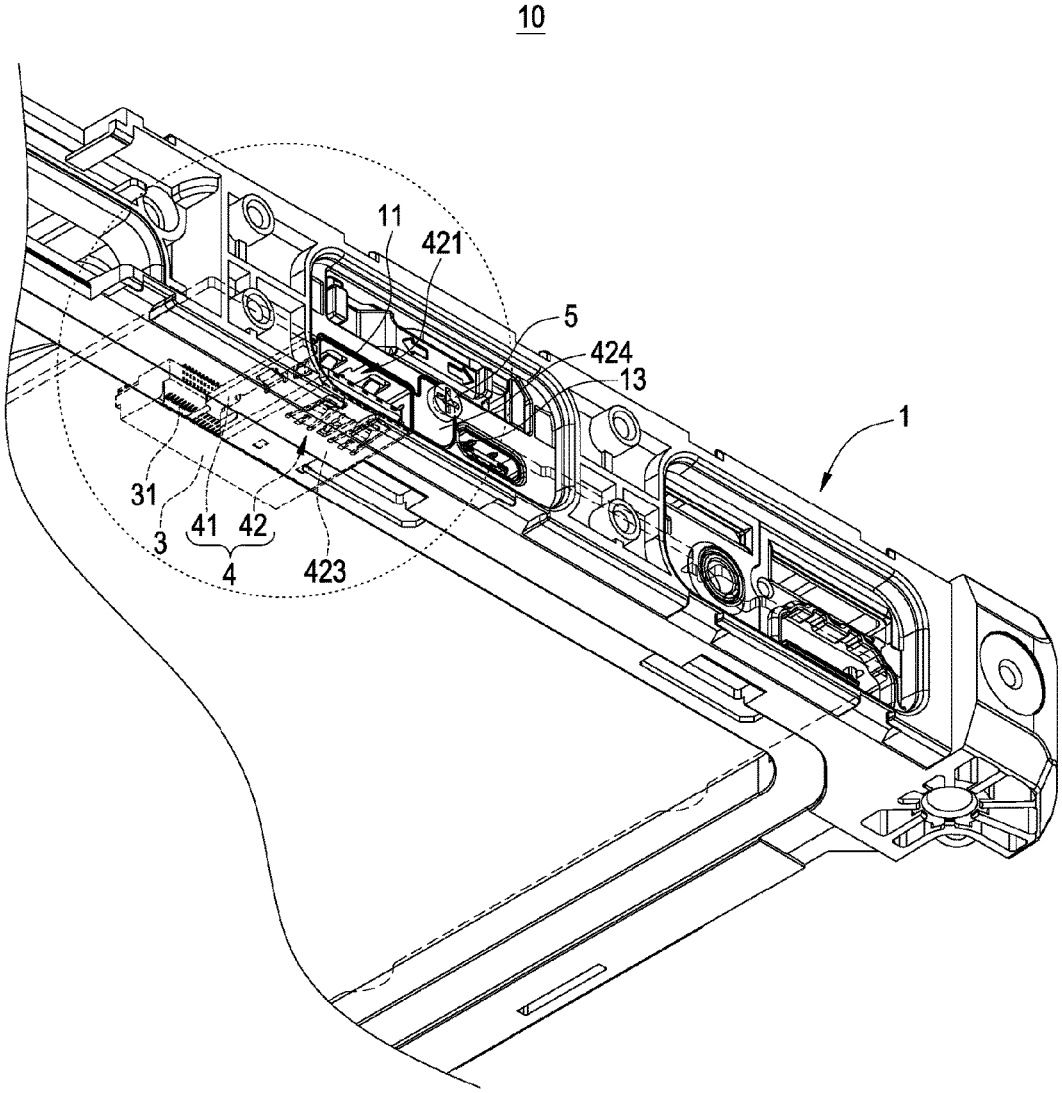
FIG. 4 is another elevational assembly diagram of an electronic device of the present invention.
Figure 5:
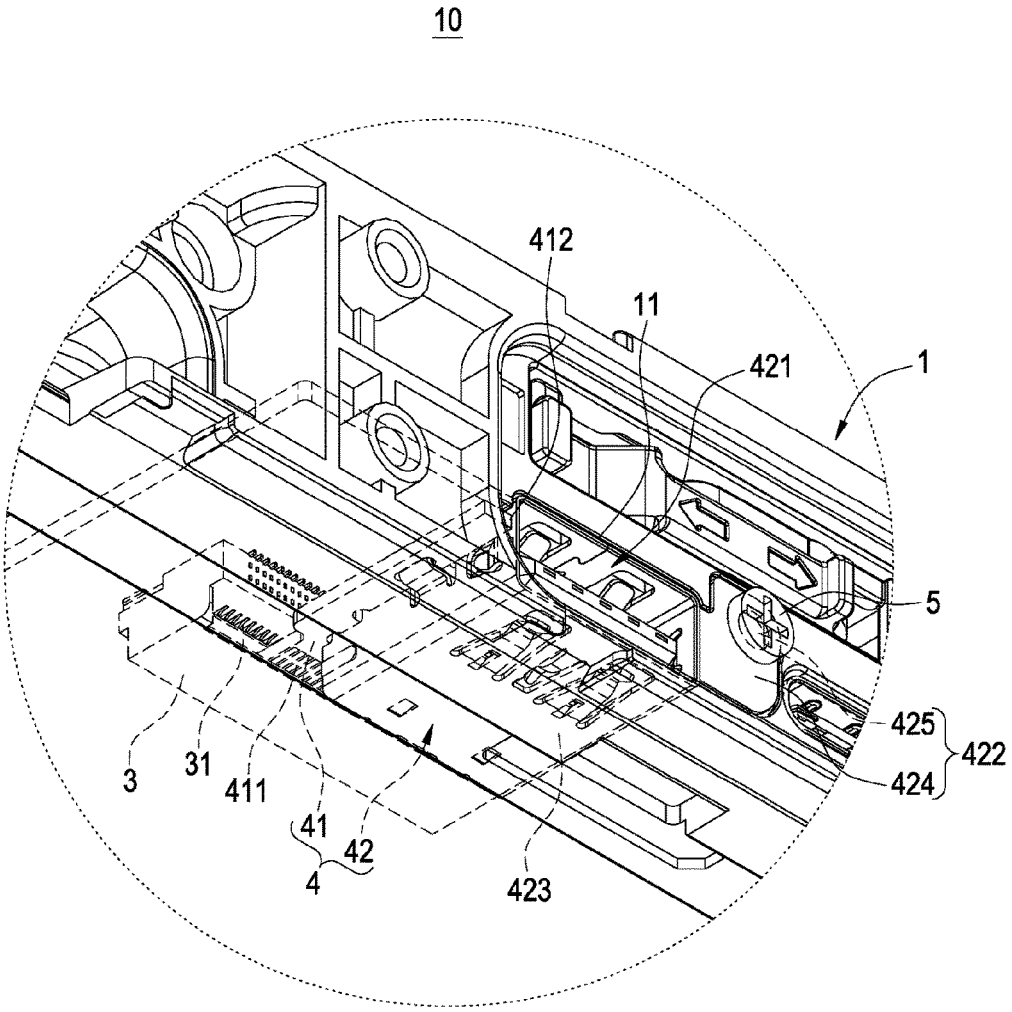
FIG. 5 is a partial enlarged elevational view of an electronic device of the present invention.
Figure 6:
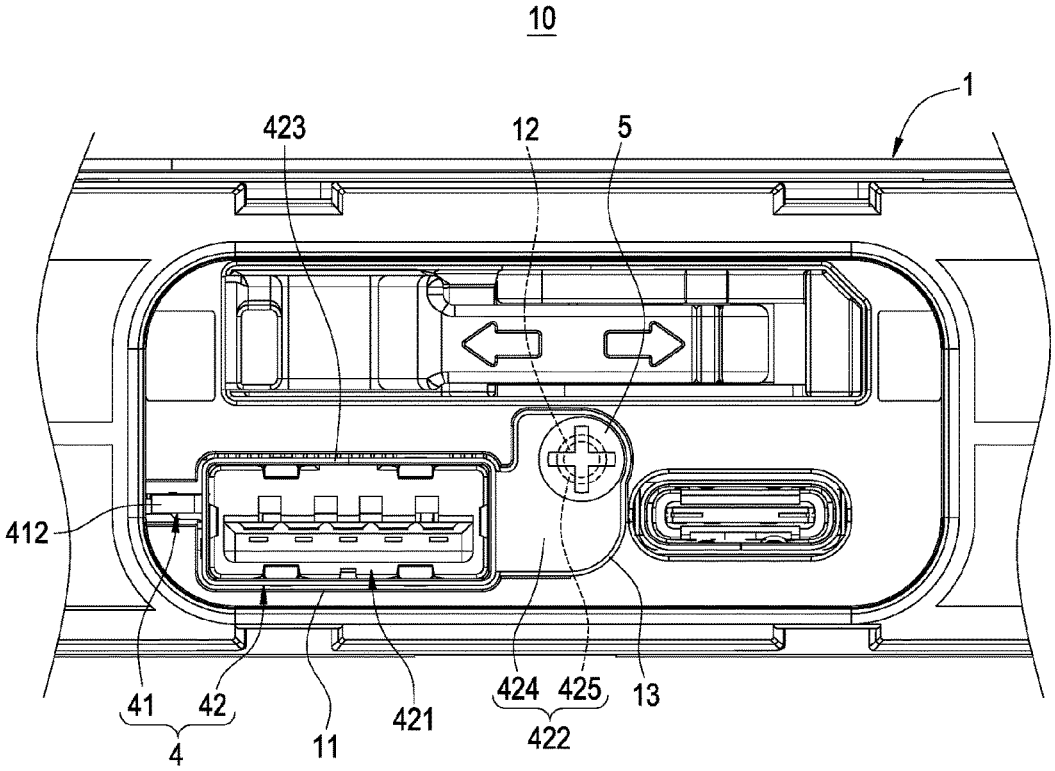
FIG. 6 is a partial enlarged front view of an electronic device of the present invention.
Figure 7:
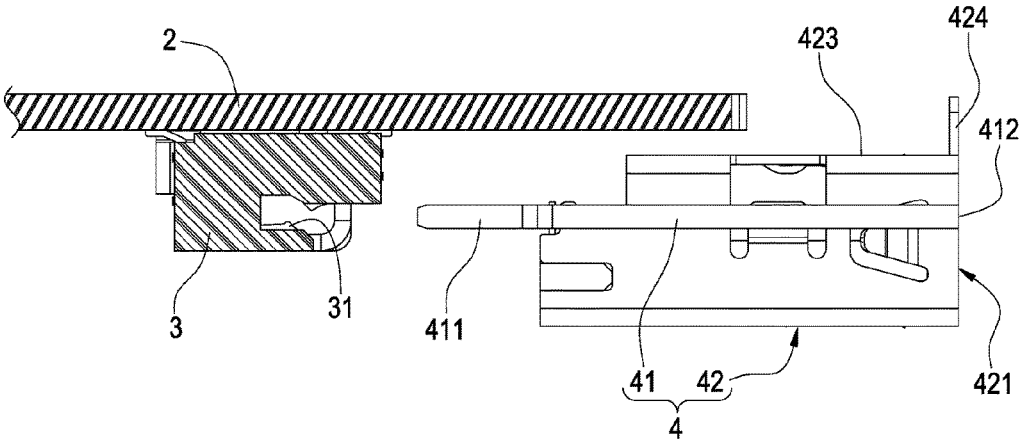
FIG. 7 is a schematic diagram of a detachable connection port in a use state of the present invention.
Figure 8:
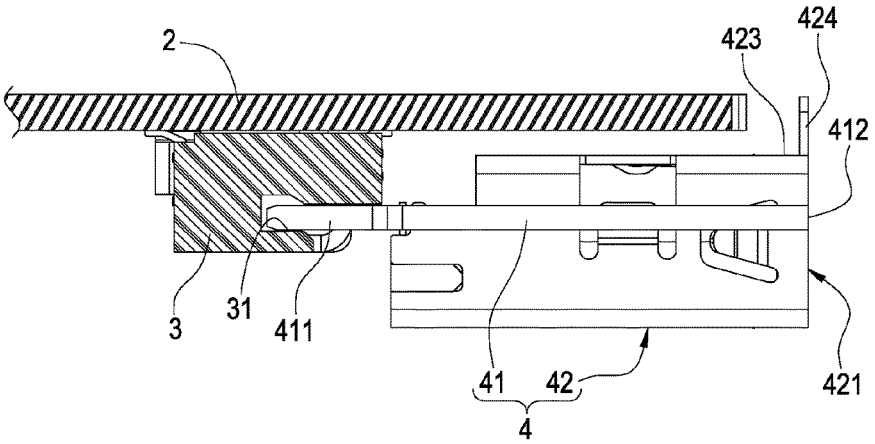
FIG. 8 is another schematic diagram of a detachable connection port in a use state of the present invention.

Referring to FIG. 1 to FIG. 8, the present invention provides a detachable connection port and an electronic device having the detachable connection port. The electronic device 10 primarily includes a main housing 1, a main circuit board 2, a board-to-board connector 3, a detachable connection port 4 and a fastening element 5. The detachable connection port 4 primarily includes a sub circuit board 41 and a socket connector 42.

As shown in FIG. 1 to FIG. 6, the main housing 1 has an opening 11 and is provided with a fastening hole 12, and is further provided with a niche 13 on one side of the opening 11. The fastening hole 12 is formed and shaped from a lower wall 131 of the niche 13. In this embodiment, the electronic device 10 may be, for example but not limited to, a laptop computer, or may be an electronic device that needs a connector for a power charging or data transmission function, such as a tablet computer or a mobile device.

As shown in FIG. 1 to FIG. 8, the main circuit board 2 is provided in the main housing 1; the board-to-board connector 3 is fixed at and electrically connected to the main circuit board 2, and includes a first connector head 31 configured correspondingly to the opening 11.

Associated details are given below. The board-to-board connector 3 is a Peripheral Component Interconnect Express (PCIE) connector, a GEN3 connector or an M.2 connector, and the board-to-board connector 3 is installed, for example but not limited to, below the main circuit board 2 in this embodiment. Alternatively, the board-to-board connector 3 is fixed at the main circuit board 2 by means of a sink-plate or mid-mount, i.e., the board-to-board connector 3 is located in a recess of the main circuit board 2.

As shown in FIG. 1 to FIG. 8, the detachable connection port 4 is detachably insertingly connected at the opening 11. The detachable connector 4 includes a sub circuit board 41 and one or multiple socket connectors 42.

The sub circuit board 41 includes a golden finger 411 at one end thereof and a front edge 412 at the other end thereof. The golden finger 411 is electrically insertingly connected at the first connector head 31, and the socket connector 42 is fixed at and electrically connected to the sub circuit board 41, thus electrically connecting the socket connector 42 to the board-to-board connector 3 through the golden finger 411.

The socket connector 42 includes a second connector head 421 exposed at the opening 11, and an installation portion 422 provided on one side of the second connector 421. In this embodiment, the socket connector 42 principally conforms to the specifications of Universal Serial Bus (USB) Type-A, and additionally forms the installation portion 422 by using a sub housing 423 formed by metal or a conductive material. When the socket connector 42 is installed on the main housing 1 of the electronic device 10 by using the fastening element 5, the socket connector 42 can be grounded through the sub housing 423 or the fastening element 5. The sub housing 423 surrounds an exterior of the second connector head 421. The installation portion 422 includes a blocking plate 424 extended from one side of the sub housing 423 of the second connector head 421 and a fixing hole 425 provided from the blocking plate 424. The blocking plate 424 is embedded in the niche 13 and mutually blocks and limits the main housing 1.

However, in other embodiments, the socket connector 42 may also partially or completely conform to the specifications of High Definition Multimedia Interface (HDMI) or USB Type-C. At this point, pin specifications of the socket connector 42 can be easily met by modifying the sub circuit board 41. Further, multiple socket connectors 42 having the same or different standards may share one sub circuit board 41, and share the same golden finger 411 to connect to the board-to-board connector 3. In other words, the detachable connection port 4 may be easily connected to multiple socket connectors 42 without having to increase the number of the board-to-board connector 3.

Associated details are further given below. The socket connector 42 is fixed at the sub circuit board 41 by means of a sink-plate or mid-mount; that is, the socket connector 42 is located in a recess of the sub circuit board 41. The front edge 412 and the second connector head 421 are exposed at the opening 11 of the main housing 1, and the shape of opening 11 of the main housing 1 corresponds to an overall shape of the sub circuit board 41 and the second connector head 421.

The socket connector 42 is a USB Type-A connector, an HDMI connector or a USB Type-C connector. In this embodiment, the number of the socket connector 42 fixed on the sub circuit board 41 is one, and the present invention is not limited to the exemplary value. The number of the socket connector 42 fixed on the sub circuit board 41 may also be plural.

As shown in FIG. 1 to FIG. 6, the fastening element 5 is penetratingly fixed at the fixing hole 425 and the fastening hole 12, so as to fix the fastening element 5 at the installation portion 422 and the main housing 1 to further install the socket connector 42 at the electronic device 10 through the installation portion 422. The fastening element 5 may be a screw of a fastener.

As shown in FIG. 1 to FIG. 8, when the electronic device 10 and the detachable connection port 4 of the present invention are in a use state, to replace the detachable connection port 4 due to damage or other reasons, a user is only required to loosen the fastening element 5 from the fixing hole 425 and the fastening hole 12, and pull the detachable connection port 4 out of the opening 11 of the main housing 1 to separate the golden finger 411 of the sub circuit board 41 from the first connector head 31 of the board-to-board connector 3, insert a new detachable connection port 4 or a detachable connection port 4 of another standard to the opening 11 of the main housing 1 to allow the golden finger 411 of the sub circuit board 41 to electrically connect to the first connector head 31 of the board-to-board connector 3, and fasten the fastening element 5 correspondingly to the fixing hole 425 and the fastening hole 12. Thus, the operation of detaching and replacing the detachable connection port 4 by a user is completed.

Accordingly, when the detachable connection port 4 is damaged, without needing to particularly sending the electronic device 10 to an original manufacturer for repairs, a user is only required to purchase a new detachable connection port 4 and can then replace the detachable connection port 4 by loosening and fastening the fastening element 5, thus achieving the advantages of easy replacement of the electronic device 10 and the detachable connection port 4 and hence reducing repair costs and standby time for a user.

Further, the board-to-board connector 3 is a PCIE connector, a GEN3 connector or an M.2 connector. Therefore, a user may also replace the detachable connection port 4 by a USB Type-A connector, an HDMI connector or a USB Type-C connector having a different standard according to actual requirements, further enhancing the utilization convenience of the electronic device 10 and the detachable connection port 4.

In conclusion of the above, the detachable connection port and the electronic device of the present invention are not disclosed by similar products or used in public, and provide industrial applicability, novelty and an inventive step, thus completely meeting the criteria for a patent application. Therefore, an application is filed according to the Patent Act, and the granting to patent rights is respectfully requested so as to protect rights the Inventor.

What is claimed is:

1. A detachable connection port, detachably installed at an electronic device, the electronic device comprising a board-to-board connector and an opening, the detachable connection port comprising: a sub circuit board, comprising a gold finger and a front edge, the front edge exposed at the opening; and a socket connector, fixed at and electrically connected to the sub circuit board, the socket connector comprising an installation portion, the socket connector installed to the electronic device through the installation portion, the socket connector electrically connected to the board-to-board connector through the gold finger; and the socket connector fixed at the sub circuit board by means of a sink-plate or mid-mount.

2. The detachable connection port according to claim 1, wherein the socket connector comprises a sub housing, and the installation portion comprises a blocking plate extended from one side of the sub housing and a fixing hole provided from the blocking plate.

3. The detachable connection port according to claim 2, further comprising a fastening element, which is penetratingly fixed at the fixing hole and is fixedly connected to the electronic device.

4. The detachable connection port according to claim 3, wherein the socket connector comprises a second connector head, the sub housing surrounds an exterior of the second connector head, and the second connector head is exposed at the opening.

5. An electronic device comprising a detachable connection port, comprising: a main housing, having an opening; a main circuit board, provided in the main housing; a board-to-board connector, fixed at and electrically connected to the main circuit board, the board-to-board connector comprising a first connector head configured correspondingly to the opening; the detachable connection port, detachably insertingly connected at the opening, the detachable connection port comprising: a sub circuit board, comprising a gold finger and a front edge, the gold finger electrically connected to the first connector head, and the front edge exposed at the opening; and at least one socket connector, fixed at and electrically connected to the sub circuit board, the socket connector comprising a second connector head exposed at the opening and an installation portion provided on one side of the second connector head; the socket connector fixed at the sub circuit board by means of a sink-plate or mid-mount; and a fastening element, fixedly connected at the installation portion and the main housing.

6. The electronic device comprising the detachable connection port according to claim 5, wherein a shape of the opening corresponds to an overall shape of the sub circuit board and the second connector head.

7. The electronic device comprising the detachable connection port according to claim 5, wherein the main housing has a fastening hole, the installation portion comprises a blocking plate extending from one side of the second connector head and a fixing hole provided from the block plate, and the fastening element is penetratingly fixed at the fixing hole and the fastening hole.

8. The electronic device comprising the detachable connection port according to claim 7, wherein the blocking plate and the main housing are mutually blocking and limiting.

9. The electronic device comprising the detachable connection port according to claim 8, wherein a niche is provided on one side of the main housing provided with the opening, the fastening hole is formed and shaped from a lower wall of the niche, and the blocking plate is embedded in the niche.

* * * * *